US011655134B1

(12) United States Patent
Perkins

(10) Patent No.: US 11,655,134 B1
(45) Date of Patent: May 23, 2023

(54) MODULAR BEVERAGE DISPENSER AND METHODS OF USE

(71) Applicant: Jay Perkins, Jackson Beach, FL (US)

(72) Inventor: Jay Perkins, Jackson Beach, FL (US)

(73) Assignee: TendedBar LLC, Jacksonville, FL (US)

( * ) Notice: Subject to any disclaimer, the term of this patent is extended or adjusted under 35 U.S.C. 154(b) by 0 days.

(21) Appl. No.: 17/161,657

(22) Filed: Jan. 28, 2021

Related U.S. Application Data

(60) Provisional application No. 62/966,764, filed on Jan. 28, 2020.

(51) Int. Cl.

| | |
|---|---|
| ***B67D 7/74*** | (2010.01) |
| ***B67D 1/00*** | (2006.01) |
| ***B67D 1/12*** | (2006.01) |
| ***G07F 13/06*** | (2006.01) |
| ***B67D 1/08*** | (2006.01) |

(52) U.S. Cl.
CPC ..... *B67D 1/0022* (2013.01); *B67D 1/0041* (2013.01); *B67D 1/0882* (2013.01); *B67D 1/1211* (2013.01); *G07F 13/065* (2013.01); *B67D 2210/00034* (2013.01)

(58) Field of Classification Search
CPC .. B67D 1/0022; B67D 1/0041; B67D 1/1211; B67D 1/0882; B67D 2210/00034; G07F 13/065
See application file for complete search history.

(56) References Cited

U.S. PATENT DOCUMENTS

| | | | | |
|---|---|---|---|---|
| 9,499,385 | B1 * | 11/2016 | Studor | G06Q 20/18 |
| 2007/0215239 | A1 * | 9/2007 | Dorney | G06Q 20/342 222/146.2 |
| 2007/0241120 | A1 * | 10/2007 | Henry | B67D 1/0877 221/2 |
| 2010/0005903 | A1 * | 1/2010 | Beavis | G01F 3/10 73/861.47 |
| 2011/0017776 | A1 * | 1/2011 | Metropulos | B67D 1/0041 222/129.1 |
| 2011/0173082 | A1 * | 7/2011 | Breitenbach | G06Q 30/0277 705/16 |
| 2011/0298583 | A1 * | 12/2011 | Libby | B67D 1/0041 340/5.2 |
| 2011/0315711 | A1 * | 12/2011 | Hecht | A47J 31/52 222/129.1 |

(Continued)

FOREIGN PATENT DOCUMENTS

| | | | | |
|---|---|---|---|---|
| CN | 101827779 A * | 9/2010 | | B67D 1/1252 |
| EP | 3291128 A1 * | 3/2018 | | |

(Continued)

*Primary Examiner* — Bob Zadeh
(74) *Attorney, Agent, or Firm* — Patterson Intellectual Property Law, P.C.; Mark A. Kilgore

(57) ABSTRACT

A modular beverage dispenser and method of use to provide an all in one solution to dispense beer, wine, liquor, mixers, cocktails and other alcoholic and non-alcoholic ingredients in a controlled, safe, and measured manner. The machines are manufactured to be modular and scalable to allow for any combination of beverage q ingredients; a machine can have any single ingredient or all of them included at once. They are designed to give customers the ability to select functions that they desire to configure a system that meets their needs and specifications.

16 Claims, 8 Drawing Sheets

(56) References Cited

U.S. PATENT DOCUMENTS

| | | | | |
|---|---|---|---|---|
| 2012/0285986 | A1* | 11/2012 | Irvin | B67D 1/0888 222/30 |
| 2013/0292407 | A1* | 11/2013 | Beavis | G01F 3/10 222/23 |
| 2015/0199882 | A1* | 7/2015 | Fernando | G06F 1/1696 345/173 |
| 2015/0344284 | A1* | 12/2015 | Perkins | B67D 1/0037 222/1 |
| 2016/0114301 | A1* | 4/2016 | Jablonski | B67D 1/12 366/141 |
| 2016/0297666 | A1* | 10/2016 | Guy | B67D 1/0085 |
| 2018/0312386 | A1* | 11/2018 | Brun-Kestler | B67D 1/0051 |

FOREIGN PATENT DOCUMENTS

| | | | | |
|---|---|---|---|---|
| GB | 2531818 A | * | 5/2016 | B67D 1/0079 |
| GB | 2553625 | * | 3/2018 | |
| GB | 2553625 A | * | 3/2018 | B67D 1/0888 |
| JP | 2004185522 | * | 7/2004 | |
| WO | WO-2019158562 A1 | * | 8/2019 | B67D 1/0857 |

* cited by examiner

MODULAR BEVERAGE DISPENSER AND METHODS OF USE

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application(s) which is/are hereby incorporated by reference: U.S. Provisional Patent Application No. 62/966,764 filed on Jan. 28, 2020.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to a modular beverage dispenser and methods of use thereof. More particularly, this invention pertains to a modular beverage dispenser that is capable of dispensing beer, wine, liquor, mixed drinks, mixers, and other alcoholic and non-alcoholic ingredients in a controlled, safe, and repeatably measured manner.

There remains a need for businesses in the hospitality industry to prepare and serve drinks more efficiently than an individual can. There are many opportunities throughout the hospitality industry, including but not limited to high volume sports & entertainment venues, hotels, casinos, cruise ships, restaurants, bars, convenience stores, and other retail applications in which a need exists to provide beverages at an efficient rate without the need for human intervention.

In the past, there has never been a solution that provides businesses the ability to use different modules offered in modular beer, wine, liquor/spirits, and mixer capacities while being able to select various modules, or all modules combined together, to produce a beverage dispensing device that does not require human intervention. Some prior art devices may allow for automatically dispensing liquids or beverages, but those devices do not allow for modular combinations of different drink types and ingredients.

The hospitality industry may become more efficient due to automation of certain services to help make up for inefficiencies of human labor. One concern is the safety and liability with having humans "free pour" alcohol for other patrons. There are little to no regulations or controls in place in the majority of establishments in the United States. Better regulation of this services allows for more safety and less liability to the establishment using an automated device of this current disclosure.

BRIEF SUMMARY OF THE INVENTION

The modular beverage dispenser is designed to be modular and expandable for building to print manufacturing of both the controls hardware, program, as well as, the structure. A customer may select options for which ingredients (and how many of each) and size requirements to determine the machine that is to be built. Depending on the selections made, the size and shape of the overall machine will differ, while each of the modules will remain the same.

DETAILED DESCRIPTION OF THE INVENTION

Figure 1:
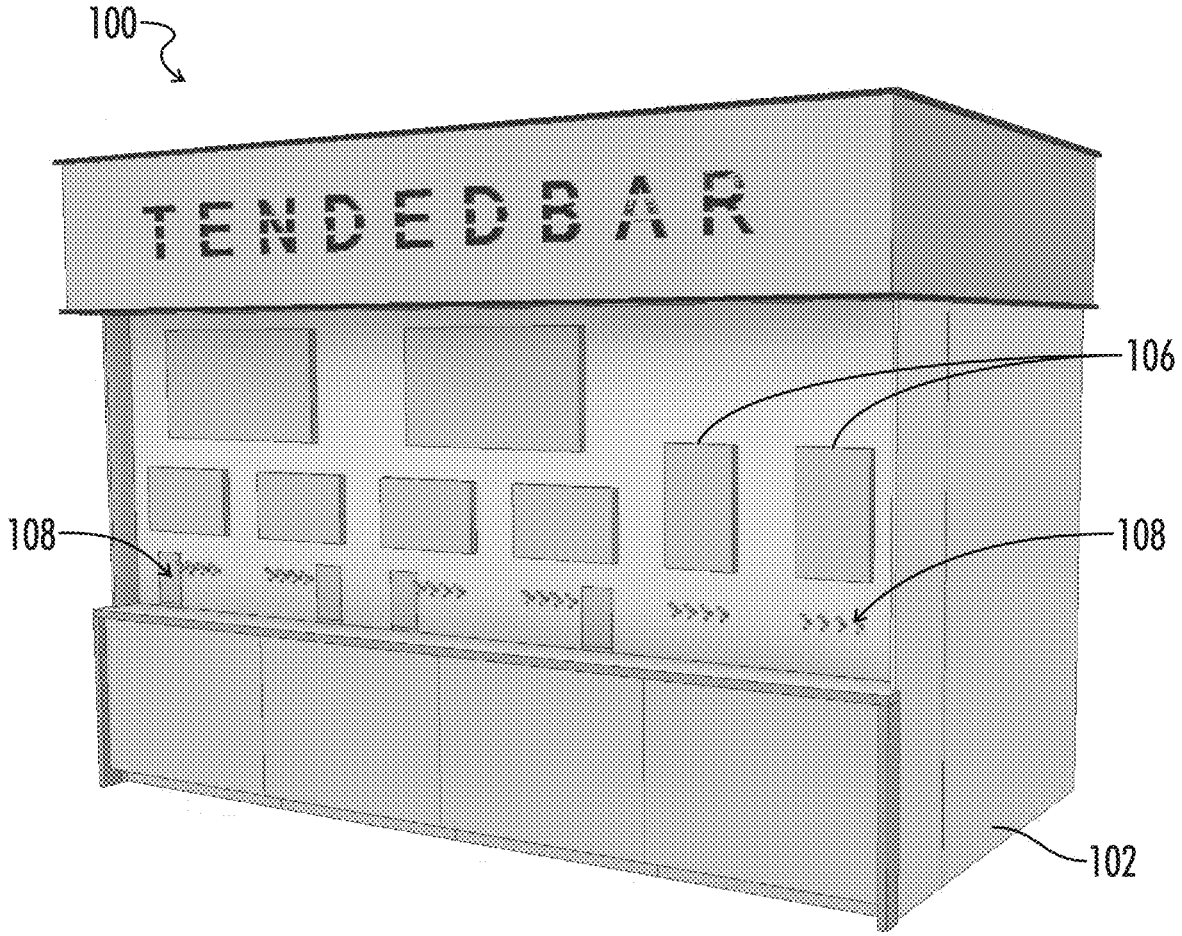
FIG. 1 is a box diagram of an embodiment of the device and its inputs and outputs.
Figure 2:
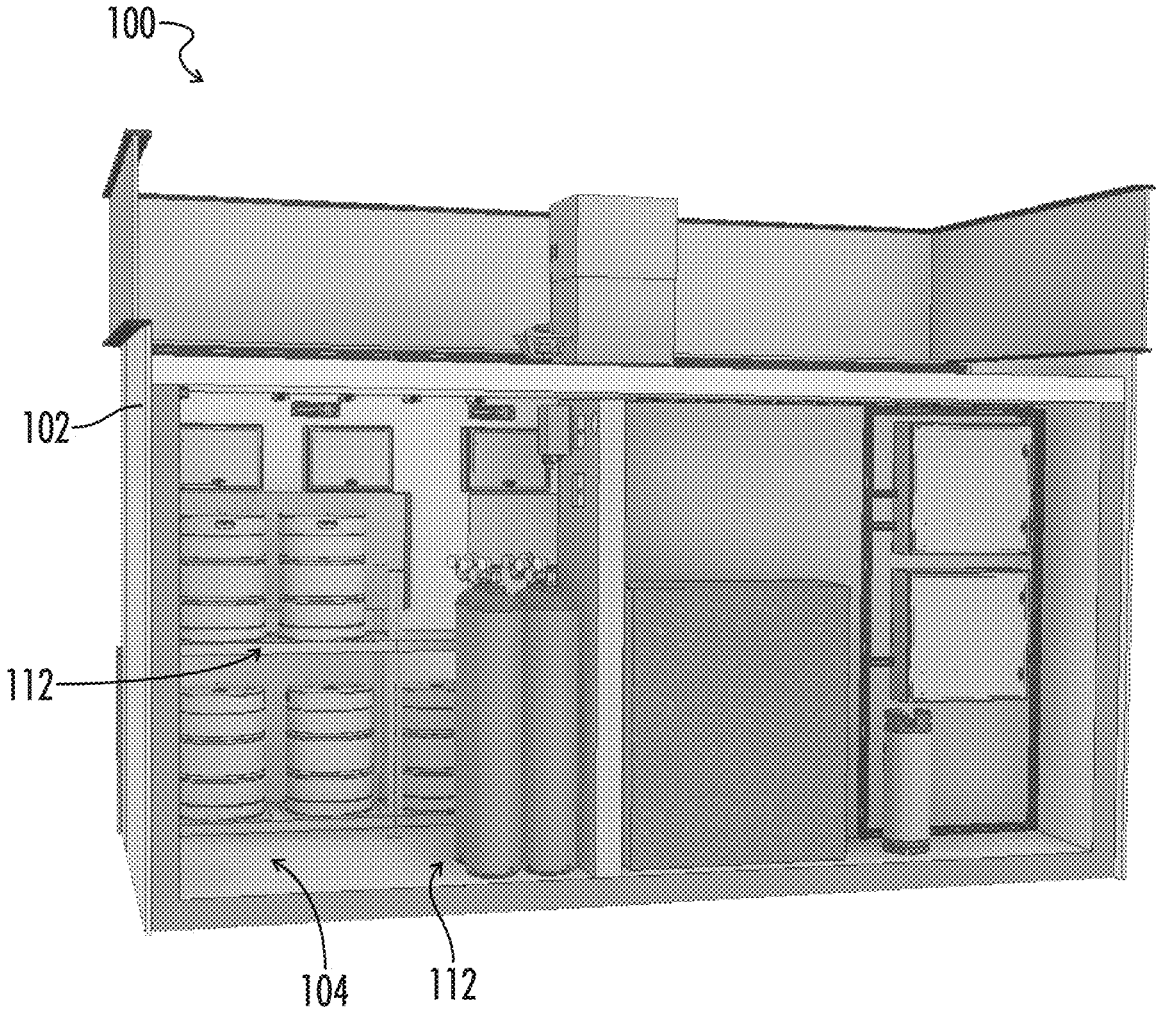
FIG. 2 is a mechanical and electrical diagram of an embodiment of the device.
Figure 3:
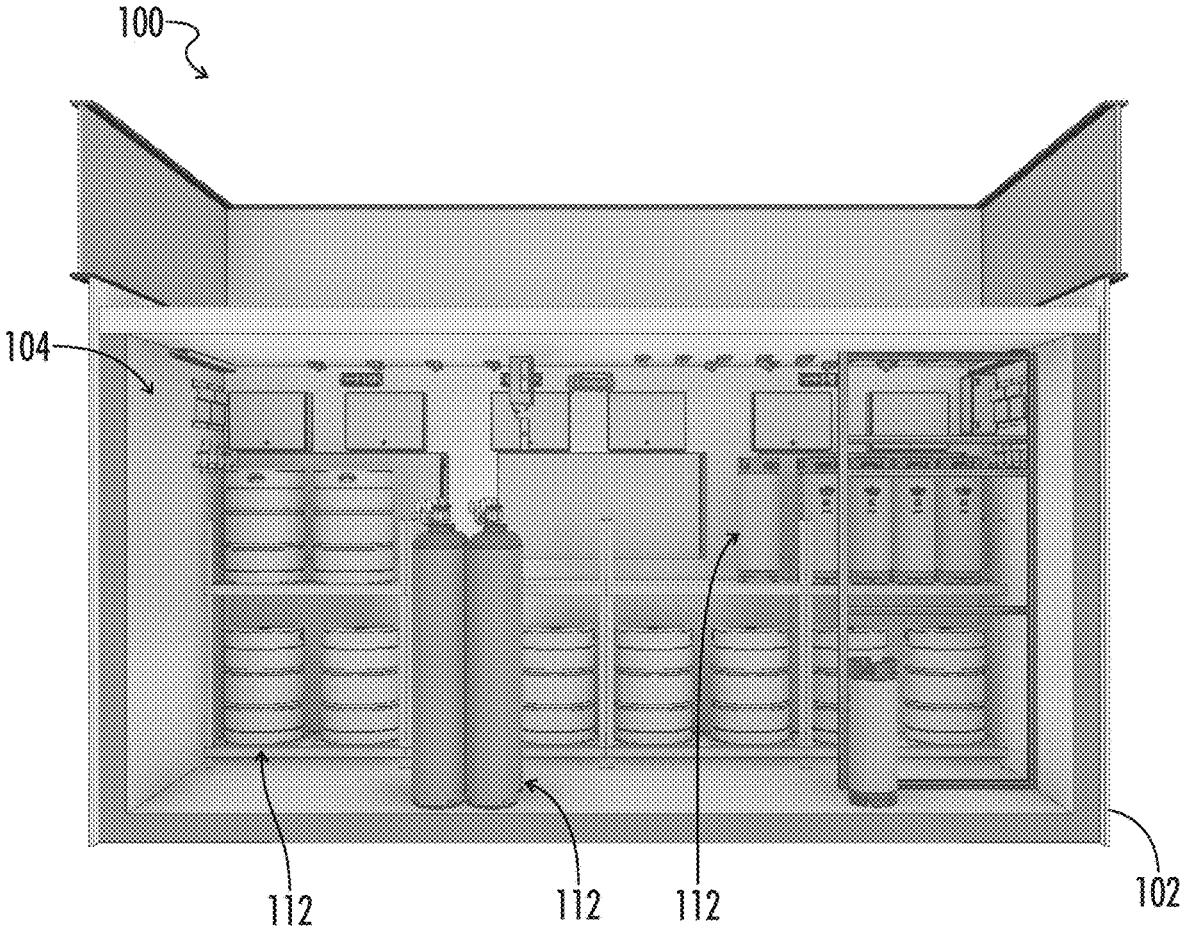
FIG. 3 is a mechanical and electrical diagram of an embodiment of the device.
Figure 4:
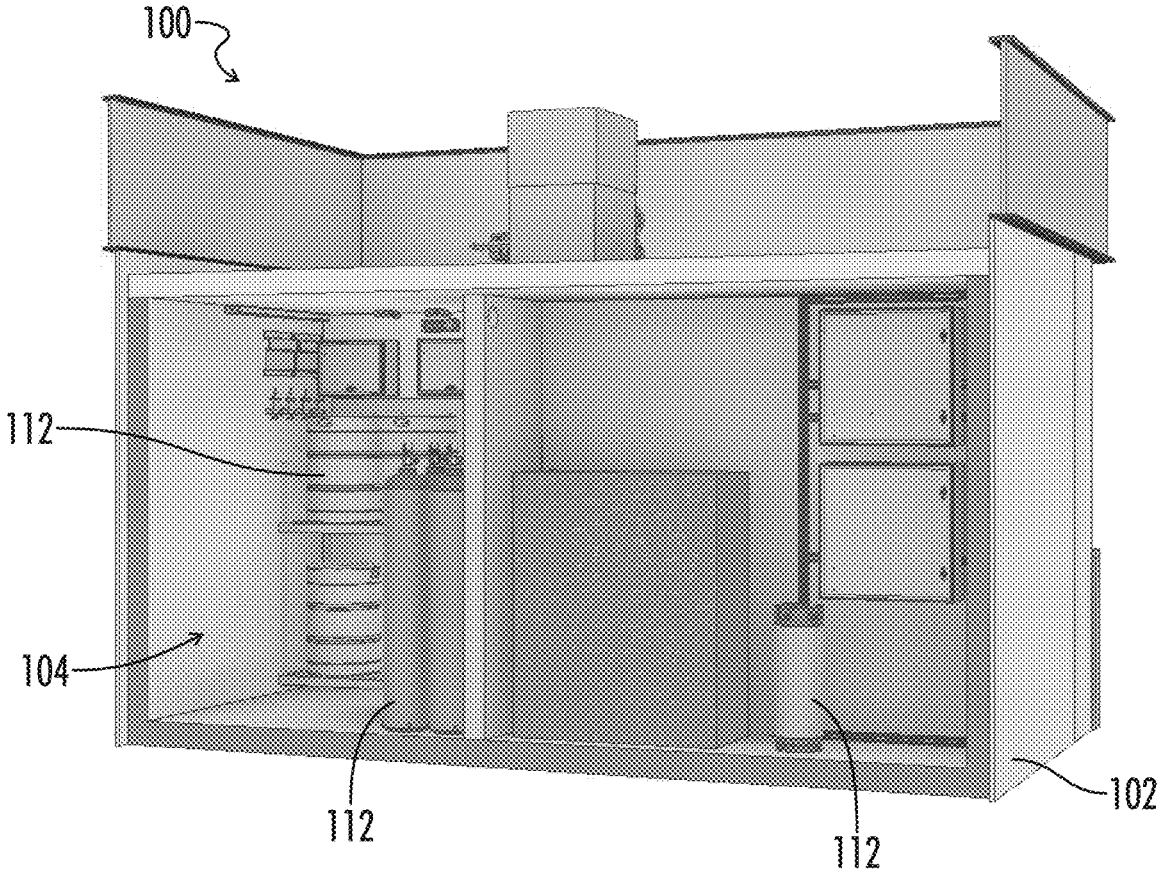
FIG. 4 is a mechanical and electrical diagram depicting the scalability of an embodiment of the device.

Reference will now be made in detail to embodiments of the present disclosure, one or more drawings of which are set forth herein. Each drawing is provided by way of explanation of the present disclosure and is not a limitation. In fact, it will be apparent to those skilled in the art that various modifications and variations can be made to the teachings of the present disclosure without departing from the scope of the disclosure. For instance, features illustrated or described as part of one embodiment can be used with another embodiment to yield a still further embodiment.

Thus, it is intended that the present disclosure covers such modifications and variations as come within the scope of the appended claims and their equivalents. Other objects, features, and aspects of the present disclosure are disclosed in, or are obvious from, the following detailed description. It is to be understood by one of ordinary skill in the art that the present discussion is a description of exemplary embodiments only and is not intended as limiting the broader aspects of the present disclosure.

The modular beverage dispenser is a system designed to dispense measured amounts of ingredients to complete recipes in a container for consumption. The system can take many different shapes and aesthetics on the exterior, but the interior of the system is designed to be completely repeatable, expandable, scalable, and configured to meet specifications as may be set forth by a customer. It will be understood by those skilled in the art that the system configuration is theoretically limitless, however there are reasonable space limitations that may restrict the various configurations.

As used herein, the term "beverage" may refer to a mixed drink, cocktail, alcoholic drink, and/or non-alcoholic drink. Said beverage may include a combination of one or more consumable beverage ingredients which in some embodiments may be alcoholic, non-alcoholic, carbonated, and/or non-carbonated. In some embodiments, a beverage may be mixed via mechanical agitation to combine the beverage ingredients. For example, a beverage may be mixed by stirring multiple beverage ingredients to form a homogenous mixture within a beverage cup (or other suitable vessel). Depending on the embodiment, stirring may involve directly agitating the beverage ingredients within the cup (e.g., with a spoon or other suitable utensil) and/or applying a suitable force to the cup, such as by rotating or vibrating the cup. In some embodiments, the dispensing of the beverage ingredients into the cup may be sufficient to mix the beverage ingredients. And yet further, in some embodiments, the beverage ingredients may be mixed prior to dispensing, or a subset of ingredients mixed and dispensed subsequent to another ingredient or set of ingredients. It should be understood that a beverage as disclosed herein may be a single beverage ingredient, homogenous mixture, or heterogenous mixture.

Referring initially to FIGS. 1-4, an embodiment of a modular beverage dispenser system 100 includes a housing 102 which may be rectangular in shape, though it will be clear to those skilled in the art based on this disclosure that the size and shape of the housing 102 may be any size and shape as required to house the internal and external components. The housing 102 may include an interior volume 104 for housing internal components. The interior volume may be comprised of a single compartment or may include multiple compartments. In some embodiments, one compartment may be configured to a different environmental condition than another, such as at a lower temperature, for example a refrigerator or freezer compartment. The housing 102 may be made of any suitable material including, but not limited to metal, brick, plastic, polymer, wood, composite, and the like. The modular beverage dispenser system be powered by a 230V power supply to supply power to items like refrigeration and glycol systems, and a 120V power supply to supply power to items like the control systems, computers, secondary power supplies, and mixer system components. The secondary power supplies may supply power to other power controls, sensors, and valves/flow controls.

In some embodiments, the exterior of the housing 102 may include a user interface 106 and a dispensing area 108. In certain embodiments, the modular beverage dispenser system 100 may include a single user interface 106 and/or a single dispensing area 108. In other embodiments, the modular beverage dispenser system 100 may include any number of user interfaces 106 and dispensing areas 108 as required for the needs of the users, the space with which it can fit, and the overall traffic flow in and around the system. The dispensing area 108 may include a space for which a user's glass, cup, or other beverage container may be placed and filled with the desired beverage. In some embodiments, the dispensing area 108 may include one or more dispensing nozzles 110 (such as shown in FIG. 5C). The dispensing nozzle 110 may be a generally annular shape including a hollow passageway that operably connects to a plumbing system, hose, tubing, or the like for dispensing a liquid from the system. In some embodiments, the dispenser 108 and/or dispensing nozzle 110 may be a traditional beer tap. In certain embodiments, a single dispenser 108 may be utilized in dispensing a mixed drink, such as a cocktail, wherein the combination of liquids converge in the dispenser and are mixed as the liquids flow through the dispenser, out of the dispensing nozzle 110 and into the beverage container. In certain embodiments, the individual liquid ingredients are dispensed individually in subsequent actions and any mixing may occur in the beverage container itself. In other embodiments, a subset of ingredients may be dispensed in the beverage container and then a second subset of ingredients are dispensed subsequently into the same beverage container. It will be clear to those skilled in the art that each of the dispensing mechanisms may be provided as necessary depending on the beverage being dispensed as well as depending on the recipe that is being used.

The modular beverage dispenser system 100 may utilize a plumbing system disposed within the interior volume 104 of the housing which may be configured to store beverage liquids, components, and other items required to dispense a beverage in an automated fashion. The plumbing system may include a plurality of storage containers 112. The storage containers 112 may be configured to house a variety of materials and/or liquids. In some embodiments, the storage containers 112 may generally be cylindrical in shape such as beer kegs or the like. The storage containers 112 may be operable to store and dispense liquids or other materials into the plumbing system such as but not limited to water, wine, beer, mixers, and various types of alcohol. In some embodiments, the storage containers 112 may be rectangular and house a flexible inner liner that is capable of being filled with fluid, such as syrup, wine, or other common means for containing and dispensing liquids in the restaurant and hospitality industries.

While not illustrated herein, the storage vessels 30 further include sensors that are operably coupled to the central processing unit 20 so as to provide data regarding the ingredient volume level disposed within each storage vessel 30.

In some embodiments, the storage containers 112 may be configured to operate at a temperature that is different than the ambient temperature of the interior 104 or of the compartment it is placed in. For instance, the storage container 112 may be configured with a cooling apparatus to cool the contents of the container to a temperature that is less than the temperature of the external environment. In other embodiments, a storage container 112 may be configured with a heating apparatus to heat the contents of the container to a temperature that is more than the temperature of the external environment.

In certain embodiments, the storage containers 112 may further include sensors that are operably coupled to a central processing unit so as to provide data regarding the volume level disposed within each storage container.

In some embodiments of the present disclosure, one of the storage containers 112 may be operable to store and dispense solid material, for instance ice. The ice storage container may be a temperature-controlled container that is configured to receive ice therein and store such ice for subsequent dispensing. It is contemplated that the ice storage container may be either operable to receive ice from an external source via an opening in the housing 102 which then transports the ice to the ice storage container, or that a conventional icemaker may be disposed within the housing 102 of the modular beverage dispenser system 100. In certain embodiments, the icemaker may be configured to maintain a programmed level of ice within the ice storage container or may be programmed to produce a certain amount of ice per time period.

The storage containers 112 may be operably coupled to delivery tubes for transporting the contents of the containers throughout the modular beverage dispenser system 100. The delivery tubes may be manufactured from a suitable durable material such as but not limited to food-grade plastic and have a hollow passage there through so as to transport ingredients disposed within the storage containers 112. Those skilled in the art will recognize that the delivery tubes may be physically arranged and/or configured within the interior volume 104 of the housing 102 in numerous different manners.

According to one or more embodiments of the present disclosure, the modular beverage dispenser system 100 may include one or more container fittings that facilitate the attachment of tubing which may allow for gases and/or liquid to flow into and out of the storage containers 112. In some embodiments, the container fittings may be configured to allow gases to flow through a first channel and a beverage ingredient to flow through a second channel. In one embodiment, air (or other suitable gases) may be pumped into the container via the first channel in the container fitting to aid in dispensing the beverage ingredient out of the container through the second channel. For example, such an arrangement may allow the beverage ingredient to be dispensed from the container at faster rate compared to a configuration in which the beverage ingredient is dispensed only via gravity induced flow. In some embodiments, the beverage ingredient may be dispensed via a combination of air (or other gas) pressure and gravity to further enhance the dispensing rate. It should be understood that various arrangements may be suitable, as the current disclosure should not be read to be limited to its specific figures or examples. In one embodiment, the fittings may be arranged to couple to containers in an upright orientation, a horizontal orientation, or at an upwardly or downwardly angled orientation. Moreover, different fittings within a single beverage dispenser system may be arranged to mount different containers in different orientations. Accordingly, a beverage dispenser system may include container fittings arranged in any suitable manner such that a beverage ingredient can be dispensed from a container via pressurized gas (e.g., air) entering the container and displacing the beverage ingredient contained therein. As noted above, pressurization of the container may allow for a beverage ingredient to be dispensed from the container faster than by gravity flow. In this manner, the pressurization of a beverage ingredient container may reduce the time required to dispense a beverage ingredient and prepare a beverage. Moreover, in some embodiments, the container fittings may be constructed and arranged to seal the beverage ingredient containers under positive pressure (i.e., a pressure greater than an ambient pressure) when the beverage ingredients are not in use. Without wishing to be bound by theory, the positive pressure may aid in maintaining the carbonation and/or flavor of the beverage ingredients, which may allow the beverage ingredients to be better preserved. Moreover, maintaining the carbonation and flavors of the beverage ingredients may reduce or eliminate the need for complex carbonating and/or flavoring systems that may otherwise be required to prepare or maintain the beverage ingredients. However, it should be understood that such systems may be included in certain embodiments of the beverage dispenser systems described herein, as the current disclosure is not limited in this regard.

Figure 5A:
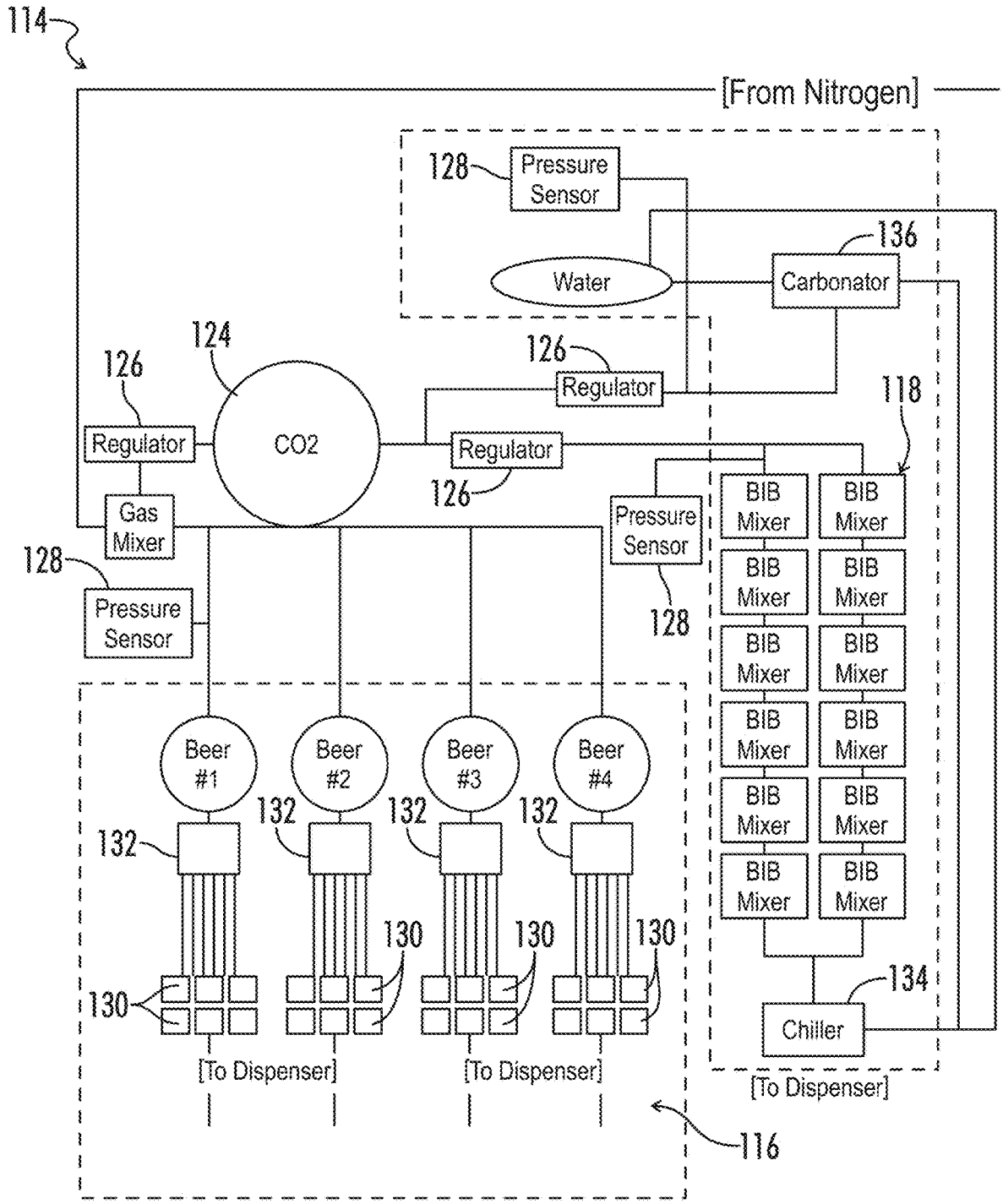
FIGS. 5A-C are an internal electrical layout of an embodiment of the device.
Figure 5B:
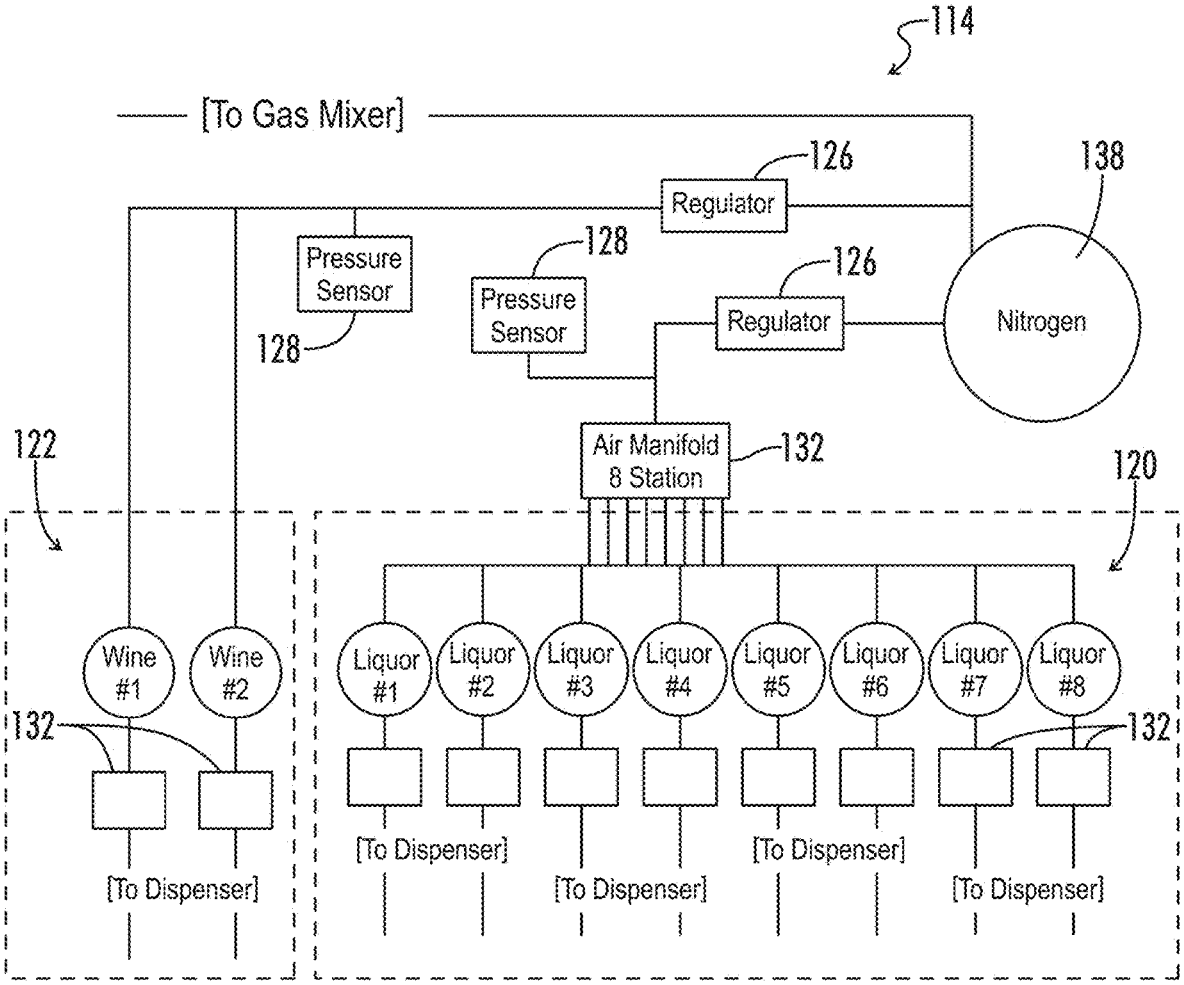
Figure 5C:
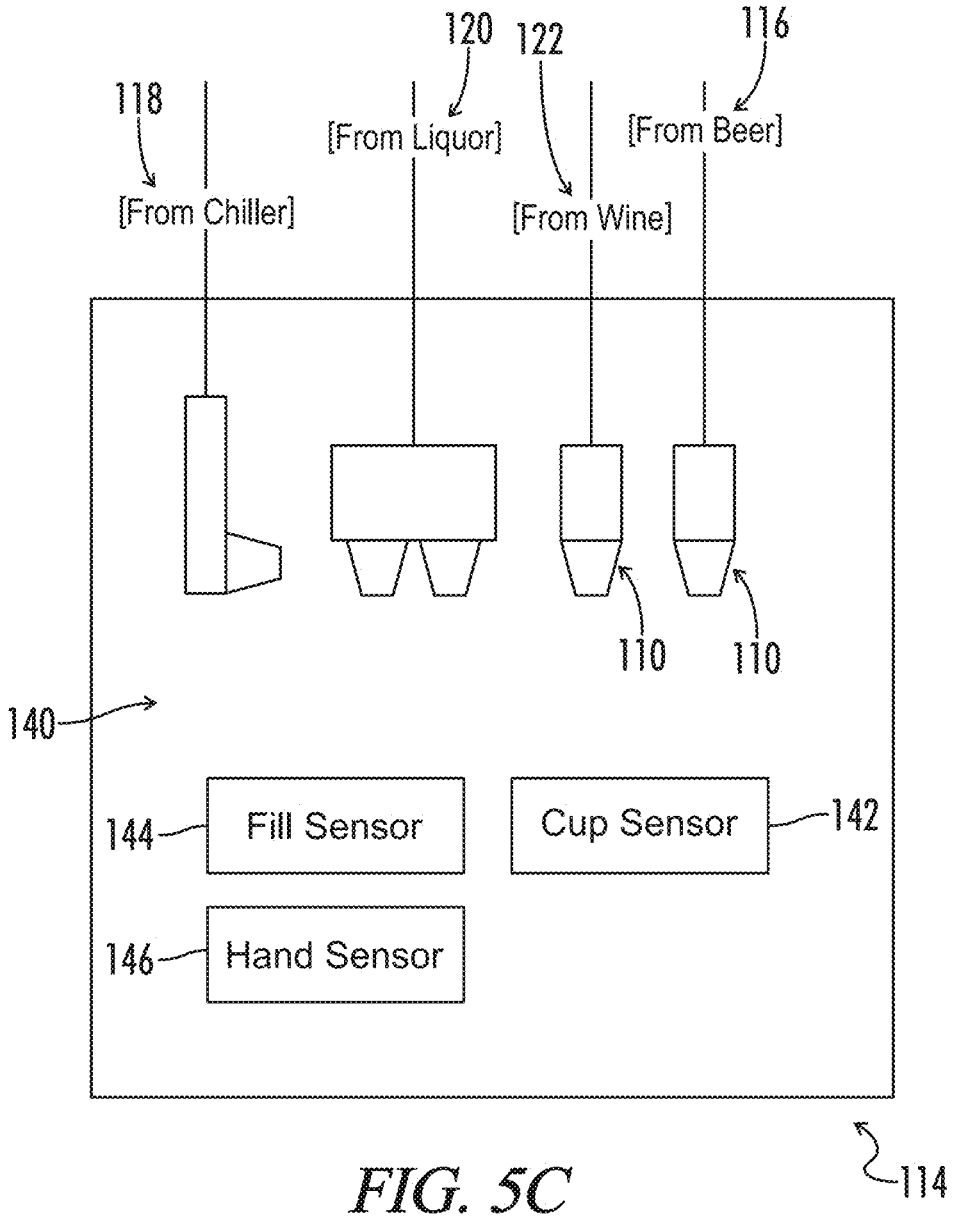

Referring now to FIGS. 5A-5C, in one embodiment according to the present disclosure, a modular beverage dispenser system 100 may include a distribution system 114 to move the one or more beverage ingredients within the system and dispense the beverage ingredients into a cup or other suitable beverage container. The distribution system 114 may include one or more pumps arranged to cause the one or more beverage ingredients to flow within the beverage dispenser system, as well as one or more valves (e.g., solenoid driven valves) associated with the storage containers 112 to selectively control the flow of gases and beverage ingredients into and out of the containers. In this manner, the pump(s) and valve(s) may cooperate to dispense a desired amount of a beverage ingredient from the containers. In some embodiments, the pumps may be used to pressurize the containers by pumping air (or other suitable gases) into the containers to cause flow of the beverage ingredient. For example, addition of pressure to a container while a valve associated with the container is open may cause the beverage ingredient to flow out of the container and be distributed within the beverage dispenser system. When the valve is closed to prevent outflow of the beverage ingredient, the pressurization may seal the storage container and may aid in retaining carbonation, flavors, or other desirable characteristics, as discussed previously. In some instances, the pressurization of the containers may allow for dispensing of a beverage ingredient without requiring activation of an associate pump. For example, opening a valve associated with a pressurized container may permit a desired quantity of the beverage ingredient to flow out of the container as some of the pressure is released.

In some embodiments, the use of pressure to cause flow of the various beverage ingredients within the beverage dispenser system may reduce or eliminate contact between the pump and the beverage ingredients, which may aid in avoiding undesired mixing of the beverage ingredients or cross contamination of beverage ingredient flavors or characteristics. Such an arrangement may allow for easier cleaning of the beverage system, as the pumps may not require cleaning that might be necessary if they contacted the beverage ingredients directly.

In addition to the above, in certain embodiments, a distribution system 114 may further include a cleaning system to rinse and/or clean various components of the distribution system that may contact the beverage ingredients, such as lines through which the beverage ingredients flow. For example, the cleaning system may be arranged to flush a cleaning agent such as water or a suitable cleaning solution through the lines of the distribution system. In some embodiments, the cleaning system may use one or more components of the distribution system, such as one or more pumps, to cause the cleaning agent to flow through the distribution system. For example, similar to the distribution of the beverage ingredients discussed above, the cleaning system may utilize pressurized air (or other gases) to cause flow of the cleaning agent through the distribution system.

As depicted in FIGS. 5A-5C, indicated by the dashed outlines, some embodiments may include four or more independent sections 116, 118, 120, 122 which make up the modular beverage dispenser system 100. Each section may be adjusted in size to allow for a desired application size or to meet a specification set forth by a customer. The size of the beverage dispenser system may range from a small tabletop unit to a large free-standing unit. The four or more independent sections may include different beverage types such as beer 116, mixers 118, liquors/spirits 120, and wine 122. As used herein, the term "mixers" may be understood as non-alcoholic ingredients including, but not limited to soda, water, soda water, seltzer, juice, energy drinks, and the like. In some embodiments, other types of beverage may also be included in other independent sections such as, but not limited to coffee, dairy products, teas, syrups, kombucha, frozen drinks, and the like. Each independent section may be separate from another section and can be used independently, or with another section. All ingredients may be maintained in each separate section from each other until the ingredients are distributed and mixed for drinking. The mixing of different ingredients may occur within the housing 1002 itself, or may occur in a container outside of the housing. The ingredients may be mixed together all at the same time, or may be added consecutively for mixing, or may be mixed together at different rates depending on the recipe requirements.

FIGS. 5A-5C further depict an embodiment of a system architecture for a modular beverage dispenser system 100. Due to space and for clarity, FIGS. 5A-5C have been divided into discrete figures, however each figure is a subset of the overall system architecture and should be viewed as such. FIGS. 5A-5C depict each of the four independent sections 116, 118, 120, 122 along with additional components. It should be understood that FIGS. 5A-5C are for illustrative purposes only, are not drawn to scale, and one of skill in the art will recognize that variations, additions, and or subtractions of the different components may be done while still remaining within the scope of this disclosure. FIG. 5A depicts a first independent section 116 which includes four types of beer and depicts a second independent section 118 which includes fourteen types of mixers as well as water. Additionally, FIG. 5A depicts a carbon dioxide container 124 which may be utilized to carbonate the various beverages or may be utilized to distribute beverage ingredients throughout the beverage system. Further, the system architecture may also include pressure regulators 126, pressure sensors 128, flow sensors 130, and pressure manifolds 132. In some embodiments, a "chiller" 134 or refrigeration unit may be operably connected to the mixers and/or water containers wherein when dispensed, the mixers and/or water plumbing will run through the chiller and reduce the temperature of the liquid before being dispensed. In some embodiments, a "carbonator" 136 may be disposed within the plumbing system so as to carbonate certain beverage ingredients. The carbonator 136 may be used in place of, or in addition to a separate carbon dioxide source 124. [0035] Similar to FIG. 5A, FIG. 5B depicts a third independent section 120 which includes eight types of liquor and depicts a fourth independent section 122 which includes two types of wine. Additionally, FIG. 5B depicts a food-grade nitrogen container 136 which may be utilized to distribute beverage ingredients throughout the beverage system. It also may be used to actuate pneumatic components, for example valves. Further, the system architecture may also include pressure regulators 126, pressure sensors 128, flow sensors 130, and pressure manifolds 132 as depicted in FIG. 5B. Turning to FIG. 5C, the system architecture may include a dispensing region 140 which includes one, two, or more dispenser nozzles 110. The plumbing system may deliver the beverage ingredients from each of the independent sections 116, 118, 120, 122 to the dispensing region 140 where the beverage ingredients are dispensed into a cup or beverage container. It will be understood that the dispensing region 140 may include a single dispensing nozzle 110 or may include multiple nozzles depending on the number of independent sections and the overall architecture of the beverage dispensing system. As illustrated in FIG. 5C, the dispensing region 140 may also include various sensors which provide information for dispensing the beverage ingredients. In certain embodiments, the system may utilize a cup sensor 142, a fill sensor 144, and a hand sensor 146. Each of these sensors may report back to a controller and its program logic through a central control network. The status of these sensors may affect the actuation of the valves and flow controls. Further, the other sensors and regulators provided in the system architecture may also report back to a controller and its program logic through a central control network and may also be utilized to affect the actuation of the valves and flow controls.

The modular beverage dispenser system 100 may use the architecture, independent modules installed, and user input to determine the recipes required to meet the user specifications. If a user selects a recipe that has multiple ingredients, the beverage dispenser system 100 may open valves or activate flow controls, allowing single or multiple ingredients, as required and by the beverage recipe to be mixed and/or poured in the container for drinking.

Each type of ingredient may be poured in a different manner depending on the viscosity, temperature, carbonation, desired flow rate, estimated usage, allotted space, and so on. Some of the ways in which an ingredient can be dispensed includes the use of pressure, pumps, or both and the use of valves or other types of flow controls.

Figure 6:
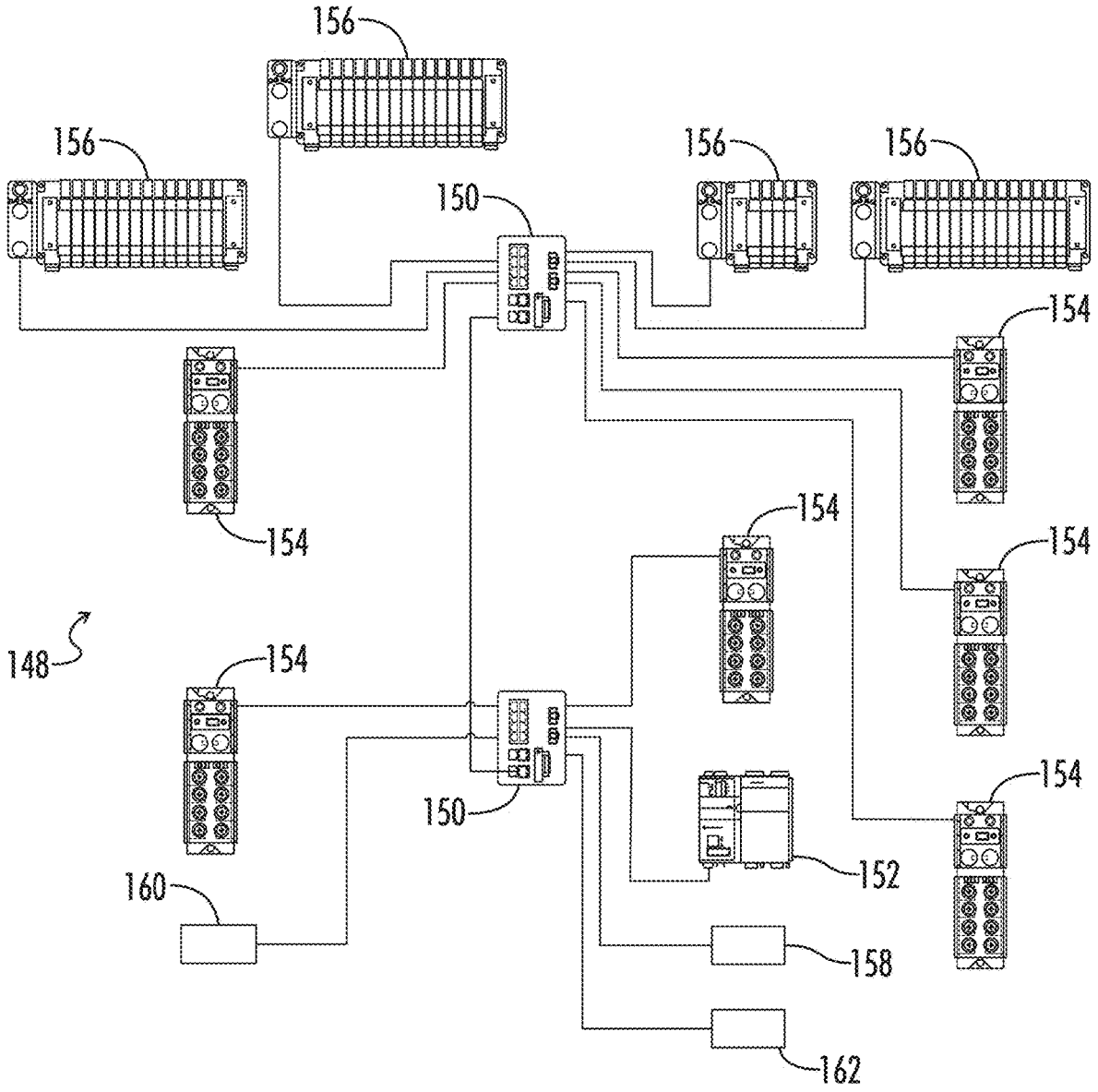
FIG. 6 is a front perspective view of an embodiment of the device.

Turning now to FIG. 6, an embodiment is depicted which illustrates a scalable industrial architecture 148 overview of the present disclosure. FIG. 6 shows an example network architecture for the industrial style controls system. It will be understood by those skilled in the art that the industrial architecture depicted in FIG. 6 may be, or may include various parts that may be referred to as the control system. "Stratix1" and "Stratix2" may be completely or partially managed industrial ethernet switches 150 to allow communications throughout the system. The "PLC" 152 may be the controller, that contains the program and logic for actuating valves and flow controls and gathering status updates from external sensors. The "IOL" modules 154 may be hubs for inputs and outputs to be controlled. These hubs may allow for 'smart' sensors to report real time statuses like temperature, flow rate, distance, on/off, communications OK, and other parameters specific to their functions. The "VM" modules 156 may be valve manifolds that may be ethernet enabled. The ethernet capability may allow for the manifolds to communicate status of valves and flow controls directly to the controller and may eliminate the need for each valve to be hardwired back to the controller. The "Database PC" 158 may be the network connection to the external environment outside of the system and may include a cloud-based database. The "indusoft PC" 160 may be the local PC that contains a database that is redundant to the cloud-based database. In addition to the redundant database, it may also allow for users to control functions (depending on the embodiment) such as putting the machine in auto/manual, troubleshooting ingredients, or viewing statuses and alerts. The "EWON" 162 may be a safe industrial firewall that remote engineers can access to help with troubleshooting and other automation specific tasks while not having to be physically present next to the machine.

In some embodiments, a modular beverage dispenser system 100 may include a controller to control one or more aspects of the preparation of a beverage. For example, the controller may be associated with the pumps, valves, sensors, user interface, and/or other components of the beverage system and may control these components to automatically prepare a desired beverage. For example, the controller may selectively activate the pumps, valves, and dispensers to dispense specific quantities of beverage ingredients into a beverage cup and mix the ingredients according to a desired beverage recipe.

In some embodiments, a controller of a beverage dispenser system performs one or more functions which may improve operation of the system. In some embodiments, the controller may include memory on which one or more predetermined system parameters are set. In some cases, these predetermined system parameters may be set by an operator, set from a remote server, and/or pre-programmed. In some embodiments, the controller may upload system parameters, sensor data, operational data, operator set system parameters, or any other suitable data to a remote server (e.g., cloud computing device). Such data may be used by the remote server to recalculate optimal system parameters which are sent back to the beverage system to modify and improve the operation of the beverage system. In some embodiments, machine learning or data fusion may be employed by the remote server to recalculate system parameters. The beverage system may connect to the remote server directly or indirectly through any appropriate channel, including, but not limited to, WiFi, Bluetooth, Cellular, wired, and/or Satellite.

As discussed previously, a modular beverage dispenser system may include one or more controllers to control various aspects of the operation of the beverage system. For example, as discussed above in connection with FIG. 6, a controller may be arranged to control the function of one or more pumps and valves to control the flow of fluids (e.g., beverage ingredients) and gases within the system. In some embodiments, the various controllers may be part of a single system control circuit. For example, the various controllers may communicate with one another via the system control circuit, and the system control circuit may coordinate the operation of the different control circuits to operate the beverage system and prepare a beverage. Thus, the system control circuit may include any suitable components to perform desired control, communication and/or other functions.

FIG. 6 depicts an example schematic diagram of a control system 148 for the beverage dispensing system 100 In the example shown, the control system 148 includes the computer controller 152, which is programmable and includes a processor and a memory. The computer controller 152 can be located anywhere in the control system 148 and/or located remote from the control system and can communicate with various components of the beverage dispensing machine via a networks, peripheral interfaces, and wired and/or wireless links. Although FIG. 6 shows one computer controller, the control system 148 can include more than one computer controller. Portions of the system and methods disclosed herein below can be carried out by a single computer controller or by several separate computer controller.

In some examples, the computer controller 152 may include a computing system that includes a processing system, storage system, software, and input/output (I/O) interfaces for communicating with peripheral devices. The systems may be implemented in hardware and/or software that carries out a programmed set of instructions. For example, the processing system loads and executes software from the storage system, such as software programmed with a dispensing method, which directs the processing system to operate as described herein below in further detail. The computing system may include one or more processors, which may be communicatively connected. The processing system can comprise a microprocessor, including a control unit and a processing unit, and other circuitry, such as semiconductor hardware logic, that retrieves and executes software from the storage system. The processing system can be implemented within a single processing device but can also be distributed across multiple processing devices or sub-systems that cooperate according to existing program instructions. The processing system can include one or many software modules comprising sets of computer executable instructions for carrying out various functions as described herein.

As used herein, the term "computer controller" or PLC 152 may refer to, be part of, or include an application specific integrated circuit (ASIC); an electronic circuit; a combinational logic circuit; a field programmable gate array (FPGA); a processor (shared, dedicated, or group) that executes code; other suitable components that provide the described functionality; or a combination of some or all of the above, such as in a system-on-chip (SoC). A computer controller may include memory (shared, dedicated, or group) that stores code executed by the processing system. The term "code" may include software, firmware, and/or microcode, and may refer to programs, routines, functions, classes, and/or objects. The term "shared" means that some or all code from multiple computer controllers may be executed using a single (shared) processor. In addition, some or all code from multiple computer controllers may be stored by a single (shared)memory. The term "group" means that some or all code from a single computer controller may be executed using a group of processors. In addition, some or all code from a single computer controller may be stored using a group of memories.

The storage system can comprise any storage media readable by the processing system and capable of storing software. The storage system can include volatile and non-volatile, removable and non-removable media implemented in any method or technology for storage of information, such as computer-readable instructions, data structures, software program modules, or other data. The storage system can be implemented as a single storage device or across multiple storage devices or sub-systems. The storage system can include additional elements, such as a memory controller capable of communicating with the processing system. Non-limiting examples of storage media include random access memory, read-only memory, magnetic discs, optical discs, flash memory, virtual and non-virtual memory, various types of magnetic storage devices, or any other medium which can be used to store the desired information and that may be accessed by an instruction execution system. The storage media can be a transitory storage media or a non-transitory storage media such as a non-transitory tangible computer readable medium.

The computer controller 152 may communicate with one or more components of the control system via the I/O interfaces and a communication link, which can be a wired or wireless link. The computer controller is capable of monitoring and controlling one or more operational characteristics of the control system and its various subsystems by sending and receiving control signals via the communication link. In one example, the communication link is a controller area network (CAN) bus, but other types of links could be used. It should be noted that the extent of connections of the communication link shown herein is for schematic purposes only, and the communication link in fact provides communication between the computer controller and each of the peripheral devices noted herein, although not every connection is shown in the drawing for purposes of clarity.

The computer controller 152 may functionally convert input signals, such as but not limited to order signals, inputs received via the user interface, or information from sensors, to output signals, such as but not limited component control signals, according to the computer executable instructions. Each of the input signals can be split into more than one branch, depending on how many functions are to be carried out and/or how many actuators are to be controlled with each of the input signals. The input signals may be fed to several software modules within the computer controller through branch signals. The exact signals input into the software modules can be taken directly from the corresponding control input device or sensor, or could be pre-processed in someway, for example by scaling through an amplifier or by converting to or from a digital signal or an analog signal using a digital-to-analog or an analog-to-digital converter. It should be appreciated that more than one input signal can be combined to provide an output signal, in which case the individual input signals may be input to the same software modules or may each be provided to an individual software module. Note that in the event that more than one signal is used to generate an output signal, a post-processing module, such as a summer, a selector, or an averaging module is used to combine the input signals into an output signal.

The provided description of the computer controller is conceptual and should be interpreted generally, as those skilled in the art will recognize many ways to implement such a computer controller. These include implementation using a digital microprocessor that receives input signals or branch signals and performs a calculation using the input signals to produce the corresponding output signals or actuator control signals. Also, analog computers may be used, which comprise circuit elements arranged to produce the desired outputs. Furthermore, look-up tables containing predetermined or calibrated data points may be stored in any fashion to provide the desired output corresponding to a given input signal.

In some embodiments, the central processing unit 152 may be operably coupled to a display screen of the user interface 106. The display screen may be a conventional LCD display touch screen that is mounted on the exterior of the housing 102 above the dispensing zone. The display screen may provide a graphical interface to program the modular beverage dispenser system 100. Those skilled in the art will recognize that the display screen could be manufactured in numerous different sizes and additionally be mounted in various positions on the housing 102. The central processing unit 152 contains sufficient memory therein to store a drink recipe database. The drink recipe database is visually accessible via the display screen. Subsequent to selecting the desired drink recipe, the central processing unit may begin transmitting signals to the beverage system to retrieve the required drink ingredients from the storage containers 112 containing the needed ingredients and transfer the programmed amount to the dispenser region 140. The central processing unit may be further operably coupled to sensors disposed within the storage containers 112 so as to provide reporting to a user of the automated drink preparation apparatus. More specifically but not by way of limitation, the central processing unit is operable to provide inventory reports, consumption reports and user access reports to a user via the display screen. Those skilled in the art will recognize that the central processing unit could be programmed to provide numerous different types of reports to a user containing various metrics therein.

Input/Output (I/O) module 154 can include input and output registers configured for receiving and transmitting command and control signals. In one embodiment, signals can be received via a wired or wireless receiver which is in signal communication with I/O module 154. Signal communications can be transmitted via near field communication ("NFC"), BLUETOOTH, Wi-Fi, infrared, or any other suitable communication technology. I/O module 154 can perform any necessary signal filtering, conversion or other manipulation prior to being passed to the processor. Similarly, after receiving a signal from a processor, the I/O module 154 can perform any necessary signal filtering, conversion or other manipulation prior to sending that signal to the appropriate control mechanism.

In some embodiments of the present disclosure, a modular beverage dispenser system 100 may include a user interface 106 to allow a user to select a desired beverage. For example, the user interface 106 may be associated with the controller, and the controller may receive a request for a desired beverage from the user input and operate the beverage system to prepare the beverage automatically. Depending on the particular embodiment, the user interface may be provided on the housing 102 and/or on an external device. In some embodiments, the user interface may include a mobile application on a device such as a tablet or smartphone, and the application may include a menu from which a user can request a desired beverage. The mobile application may be arranged to communicate with the beverage system, allowing the user interface to display notifications or other indications of the progress for the beverage preparation process. For example, the user may receive a notification on the device when the beverage preparation is completed.

In some embodiments of the present disclosure, the user interface 106 may be configured to authenticate or register a user and the selections, the number of selections, the selection history, and the like about the user. In certain embodiments, the user interface 106 may include a reader which requires the user to provide credentials before allowing access to the selections. For example, the reader may be a barcode reader which reads a barcode on a bracelet, keycard, mobile application, stationary, and the like. Other embodiments may include NFC devices, RFID, QR codes, or other similar technology for authenticating and/or verifying a user.

In certain embodiments, the user interface 106 may be configured to monitor and/or manage inventory of the beverage ingredients in the beverage system. Such an inventory management system may allow for tracking of the usage of the different beverage ingredients, and may notify a user is a container of a beverage ingredient is in need of replacement.

In some embodiments, the user interface 106 may permit customization of a desired beverage. For example, a user may select a customized quantity of one or more beverage ingredients comprising a particular beverage. In this manner, individual users may specify the quantities and/or ratios of beverage ingredients if desired in some embodiments, the user interface 106 may allow an individual user to save a custom beverage recipe to allow for simple reordering of the customized beverage.

Moreover, a modular beverage dispenser system 100 may include one or more user data input devices (such as buttons, dials, knobs, a keyboard, a touch screen or other), information display devices (such as an LCD display, indicator lights, etc.), and/or other components for providing desired input/output and control functions. In some embodiments, the input device and/or information display device may be a mobile device (such as a smart phone, a tablet, etc.) that communicates wirelessly to the system control circuit (e.g., via a Bluetooth and/or Wi-Fi protocol) such that a user may wirelessly control the operation of the beverage system.

In some embodiments a user interface 106 may include a mobile application configured to run on a mobile device to control the beverage system. For example, the mobile application may present an array of possible beverages that may be prepared based on the beverage ingredients installed on the beverage system. In some embodiments, the mobile application may allow a user to search for a particular beverage based on the name of the beverage, and/or one or more beverage ingredients. For instance, a user may search for a particular type of alcoholic beverage ingredient, and the mobile application may display all of the beverages that the system may be able to prepare including that alcoholic beverage ingredient. A user may select a desired beverage from the user interface to request the beverage, and the mobile application may communicate the beverage request to an associated beverage system to prepare the beverage. For example, in some instances, the beverage request may be added to a queue, and the beverage system may prepare beverages according to the order of beverage requests in the queue. Moreover, the mobile application may be arranged to provide one or more notifications to the user to indicate the status of a beverage request, e.g., a notification that a beverage has been prepared.

In some embodiments, a user interface 106 may display information about a particular beverage when a user selects the beverage on the user interface. For example, such information may be beneficial if a user is not familiar with a particular beverage displayed on the user interface 106. The detailed information displayed when selecting the beverage may include the various ingredients that comprise the beverage, as well as the specific proportions of those ingredients. In this manner, the information displayed on the user interface 06 may allow a user to select a desired beverage after learning of the ingredients of that beverage.

In addition to allowing a user to select a desired beverage, in some embodiments, a user interface may include one or more elements for managing a beverage system. For example, a user interface 106 may be arranged to display a status of the beverage system, which may include the quantity of the various beverage ingredients remaining in respective beverage ingredient containers attached to the system. In particular, in the depicted embodiment, the user interface 106 is arranged to display a percentage of beverage ingredients remaining for six alcoholic beverage ingredients and eight non-alcoholic beverage ingredients (e.g., non-carbonated and/or carbonated). Such information may be beneficial to indicate when a container of a particular beverage ingredient is nearing empty and needs to be changed. Moreover, in some embodiments, the user interface 106 may include one or more interface elements to control a cleaning system, as discussed previously. For instance, the user interface may allow a user to select a desired cleaning interval such that the cleaning system is operated automatically after a predetermined amount of time and/or after a predetermined number of beverages have been prepared. Alternatively or additionally, a the user interface may allow a cleaning process to be initiated as needed.

In some embodiments, the user interface may include an age verification module. The age verification module may be operably coupled to the central processing unit and is configured to scan and retrieve data from identification cards such as but not limited to driver's licenses. The age verification module may utilize optical scanners and/or magnetic strip readers to retrieve data from cards such as but not limited to credit cards and identification cards. The age verification module provides the functionality for the modular beverage dispenser system 100 to function as a self-serve machine. Utilizing the age verification module, a user will position their driver's license so as to read by the age verification module. The age verification module will transmit the data read from the driver's license to the central processing unit wherein the central processing unit verifies the age of the user inputting the driver's license. Subsequent verification of a legal drinking age, the user is provided prompts on the display screen that will facilitate the ordering of a drink. Additionally, during the process of ordering a drink, the age verification module is utilized to accept payment for the drink via a credit card. It is further contemplated within the scope of the present invention that the central processing unit will maintain a temporary database of each user's information within a programmed time period so as to limit the quantity of beverages that can be purchased over a programmed time period. By way of example but not by way of limitation, the central processing unit could be programmed to inhibit the sale of a beverage that exceeds more than one per hour for the same user. Those skilled in the art will recognize that the central processing unit could be programmed in a variety of different manners to control the consumption of beverages when the modular beverage dispenser system 100 is being utilized in a self-serve mode.

As illustrated in FIG. 5C, a sensor may be utilized to determine the placement of a cup or beverage container which is ready for dispensing of the beverage ingredients. In some embodiments, a load cell may be utilized to determine whether a cup or beverage container is positioned correctly for dispensing. In some embodiments, an ultrasonic sensor may be used to determine the presence of a cup for dispensing the beverage. The ultrasonic sensor may be configured to sense whether a cup is present in the correct location. The controller may be in communication with the ultrasonic sensor and may be configured to control the valves and actuators for the dispensing of the beverage ingredients. The ultrasonic sensor may further be configured to sense in succession in order to rule out a false reading caused by a temporary obstruction, such as an operator's hand, located in the gap between the ultrasonic sensor and the placement of the cup. In certain examples, the ultrasonic sensor could instead be an optical sensor or any type of proximity sensor.

In some embodiments, the method of using a modular beverage dispensing device as described above may include the following: Ingredients are manually loaded into system at time of set up (per specification); Recipes are manually configured into system at time of set up (per specification); Customer interaction of recipe selection captured by point of sale system and input into central database; Central database triggers programmable controller that new entry has been loaded into database; Programmable controller searches for new entries in central database. Programmable controller locates new entries and writes to central database that the recipe is being poured; Programmable controller communicates through the industrial standard automation network to actuate valves and flow controls of ingredients for determined recipe; Ingredients are dispensed from the machine individually into the container for drinking; Recipe completes when each of the ingredients has been dispensed completely into the container for drinking; Programmable controller writes to central database that the recipe has been poured; Point of sale system reads database to determine when a drink has been poured; Point of sale system writes to central database to add transaction to the correct ticket.

Ingredients, drains, and controls may be housed internal to the machine, but they may also be distributed throughout a venue depending on the space in a venue. Trunk lines may be utilized in a space to distribute ingredients from a back room or a walk-in cooler to allow for one group of ingredients to be utilized at one or multiple locations. Water can be self-contained within the machine or it can be plumbed in through an external water hook up.

Thus, although there have been described particular embodiments of the present invention of a new and useful it is not intended that such references be construed as limitations upon the scope of this invention except as set forth in the following claim.

Thus, although there have been described particular embodiments of the present invention of a new and useful MODULAR BEVERAGE DISPENSER AND METHODS OF USE it is not intended that such references be construed as limitations upon the scope of this invention except as set forth in the following claims.

What is claimed is:

1. A modular beverage dispensing system comprising:

a housing comprising an interior volume for housing internal components, the interior volume having a plurality of compartments, wherein at least one of the plurality of compartments is configured to maintain a different temperature condition than another at least one other of the plurality of compartments;

a plurality of user interfaces disposed about an exterior of the housing;

a first power supply of 120V and a second power supply of 230V;

a dispensing area disposed about the exterior of the housing, the dispensing area having a first dispensing section configured to dispense beer, a second dispensing section configured to dispense mixers, a third dispensing section configured to dispense liquors or spirits, and a fourth dispensing section configured to dispense wine, wherein the dispensing area includes a beverage container sensor;

a plumbing system having at least a portion disposed within the interior volume of the housing configured to store beverage liquids comprising at least one of the beer, mixers, liquors or spirits, or wine;

a controller comprising a processor and memory, wherein the memory has stored a plurality of beverage recipes from which a user may select via at least one of the plurality of user interfaces, the controller configured to dispense one or more ingredients required by the recipe into a user's beverage container in the dispensing area;

the controller operably connected to the beverage container sensor wherein the dispensing of the selected recipe will only commence when the beverage container sensor is activated.

2. The modular beverage dispensing system of claim 1 wherein the temperature difference is from 10° F. to 80° F.

3. The modular beverage dispensing system of claim 1 wherein the temperature difference is from 10° F. to 50° F.

4. The modular beverage dispensing system of claim 1 wherein at least one of the plurality of compartments is configured to be a refrigerator or a freezer compartment.

5. The modular beverage dispensing system of claim 1 wherein the dispensing area includes one or more dispensing nozzles operably connected to the plumbing system.

6. The modular beverage dispensing system of claim 1 wherein the plumbing system further includes a storage vessel having a sensor that is operably connected to the central processing unit wherein the sensor provides data regarding liquid volume level within the storage vessel.

7. The modular beverage dispensing system of claim 6 wherein the storage vessel includes a cooling apparatus to cool the liquid within the storage vessel.

8. The modular beverage dispensing system of claim 6 wherein the storage vessel includes a heating apparatus to heat the liquid within the storage vessel.

9. The modular beverage dispensing system of claim 6 wherein the plumbing system further comprises a chiller, the liquid stored within a storage vessel being transported from the storage vessel, through the chiller, and to the dispensing area.

10. The modular beverage dispensing system of claim 1 wherein the dispensing area comprises a fifth dispensing section configured to dispense coffee or hot tea.

11. The modular beverage dispensing system of claim 1 wherein the interior volume comprises a carbon dioxide storage vessel or a nitrogen storage vessel, or both.

12. The modular beverage dispensing system of claim 1 wherein the dispensing area further comprises a fill sensor operably connected to the controller.

13. The modular beverage dispensing system of claim 1 wherein the dispensing area further comprises a hand sensor operably coupled to the controller.

14. The modular beverage dispensing system of claim 1 wherein the beverage container sensor is an ultrasonic sensor.

15. The modular beverage dispensing system of claim 14 wherein the beverage container sensor is configured to sense in successive intervals to rule out false readings prior to dispensing.

16. The modular beverage dispensing system of claim 1 wherein the beverage container sensor is an optical sensor.

* * * * *